US005187839A

United States Patent [19]

Collins

[11] Patent Number: 5,187,839

[45] Date of Patent: Feb. 23, 1993

[54] SUSPENDER LOOP BUCKLE

[75] Inventor: Walter Collins, San Francisco, Calif.

[73] Assignee: Suspended Animation, Inc., South San Francisco, Calif.

[21] Appl. No.: 864,948

[22] Filed: Apr. 7, 1992

[51] Int. Cl.[5] ..... A44B 11/00

[52] U.S. Cl. ..... 24/170; 24/191; 24/308

[58] Field of Search ..... 24/170, 191, 585, 615, 24/519, 520, 265 BC, 308, 309, 310, 311

[56] References Cited

U.S. PATENT DOCUMENTS

| | | | |
|---|---|---|---|
| 844,540 | 2/1907 | Roy et al. | 24/170 |
| 1,763,100 | 6/1930 | Mendosa | 24/265 BC |
| 2,148,585 | 2/1939 | Schlesinger | 24/170 |
| 2,816,339 | 12/1957 | Prete, Jr. et al. | 24/170 |
| 3,011,237 | 12/1961 | Prete, Jr. | 24/170 |
| 3,676,901 | 7/1972 | Monti | 24/309 |
| 4,125,115 | 11/1978 | Mayo et al. | 24/311 |
| 4,564,983 | 1/1986 | Saito | 24/170 |

FOREIGN PATENT DOCUMENTS

| | | | |
|---|---|---|---|
| 0011722 | 11/1880 | Fed. Rep. of Germany | 24/308 |
| 1141618 | 9/1957 | France | 24/170 |
| 0001288 | of 1889 | United Kingdom | 24/308 |
| 0023793 | of 1906 | United Kingdom | 24/308 |
| 0525915 | 9/1940 | United Kingdom | 24/308 |

*Primary Examiner*—Victor N. Sakran

*Attorney, Agent, or Firm*—Heller, Ehrman, White & McAuliffe

[57] ABSTRACT

A suspender loop buckle which has a latch for adjustment of the size of the loop and a clamp for secure attachment of the suspender strap to the buckle. The latch and clamp mechanisms both consist of a pivoting plate attached to the frame of the buckle and operate under similar principles. In the open position a plate is perpendicular to the frame and the strap can move freely between the plate and the frame. In the closed position a plate is parallel to frame and the strap is secured by pressure against a serrated flange. Whereas the latch can be easily opened by pressure on the edge of the latch in the direction of the frame, the clamp cannot be opened in this manner. The strap can be quickly and easily secured to the buckle without the use of special tools. The strap can also be easily disengaged from the buckle.

11 Claims, 2 Drawing Sheets

SUSPENDER LOOP BUCKLE

FIELD OF THE INVENTION

This invention relates to fastening devices, and more particularly to devices for adjustably closing a loop of material. In particular, this invention relates to an adjustable suspender loop buckle.

DESCRIPTION OF THE PRIOR ART

Suspender loop buckles are generally composed of a frame plate with a latch mechanism at one end, and the other end suited for permanent attachment with a suspender strap. The suspender loop is formed by securing the strap to the buckle at the permanent attachment end of the buckle and passing the strap through the latch mechanism. When the latch mechanism is closed, the strap cannot feed through the latch and the loop is fixed in size. When the latch is in the open position, the strap can move through the buckle and the size of the loop is adjustable. A disadvantage of permanent attachment of the buckle to the strap is that the buckle cannot be easily removed for machine washing of the strap.

One common type of suspender buckle has an aperture through the permanent attachment end of the frame plate. The aperture has dimensions larger than the cross-sectional dimensions of the suspender strap. An end of the suspender strap is permanently secured to the buckle by passing the strap through the aperture, folding the strap over onto itself, and sewing the two layers of strap material together. Although this method of attaching the buckle to the suspender strap provides a secure attachment, the sewing step is labor intensive and therefore expensive, and removal of the buckle from the strap is difficult.

An improved suspender buckle recently introduced to the market replaces the aperture of the aforementioned buckle with a serrated flange at the permanent attachment edge of the buckle, and a pair of bendable arms which extend from the side of the frame plate near the serrated flange. A suspender strap is secured to the buckle by placing an end of the strap across the serrated flange and bending the arms down so as to hold the strap against the flange. The teeth of the serrated flange protrude into the strap, preventing displacement of the strap. Although this provides a secure attachment of the strap to the buckle, removal of the buckle from the strap is difficult, and in mass production a special tool must be used to bend the arms in against the strap thereby increasing the complexity and cost of assembly.

Thus, it is an object of the present invention to provide an improved suspender loop buckle which can be assembled with a suspender strap to form a suspender loop with a minimum of labor and no special tools.

Another object of the present invention is to provide a suspender loop buckle which can be securely attached to a suspender and yet can also be easily removed from the suspender.

SUMMARY OF THE INVENTION

The suspender loop buckle of the present invention is comprised of a frame, a latch plate and a clamp plate. The latch plate and clamp plate are pivotally attached to the frame plate and can be oriented in either an open position or a closed position. When a plate is in the open position a suspender strap can be moved freely between the plate and the frame. When a plate is in the closed position a strap positioned between the plate and the frame is wedged against a serrated flange and secured in place. The latch mechanism is designed so as to be easily openable. The clamp mechanism is also openable. The buckle can be quickly and easily secured to the strap without the need for special tools, and the buckle is easily removed from the strap for machine washing.

DETAILED DESCRIPTION OF THE PRESENT INVENTION

Figure 1:
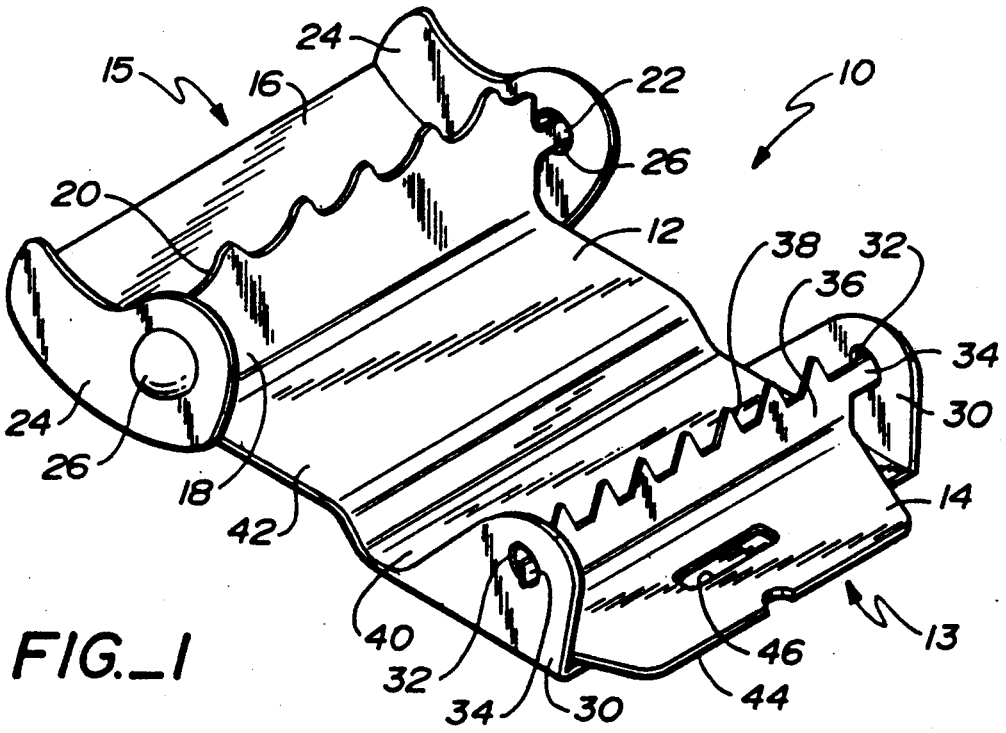
FIG. 1 the buckle of the present invention with the clamp plate and latch plate splayed in horizontal orientations.
Figure 2:
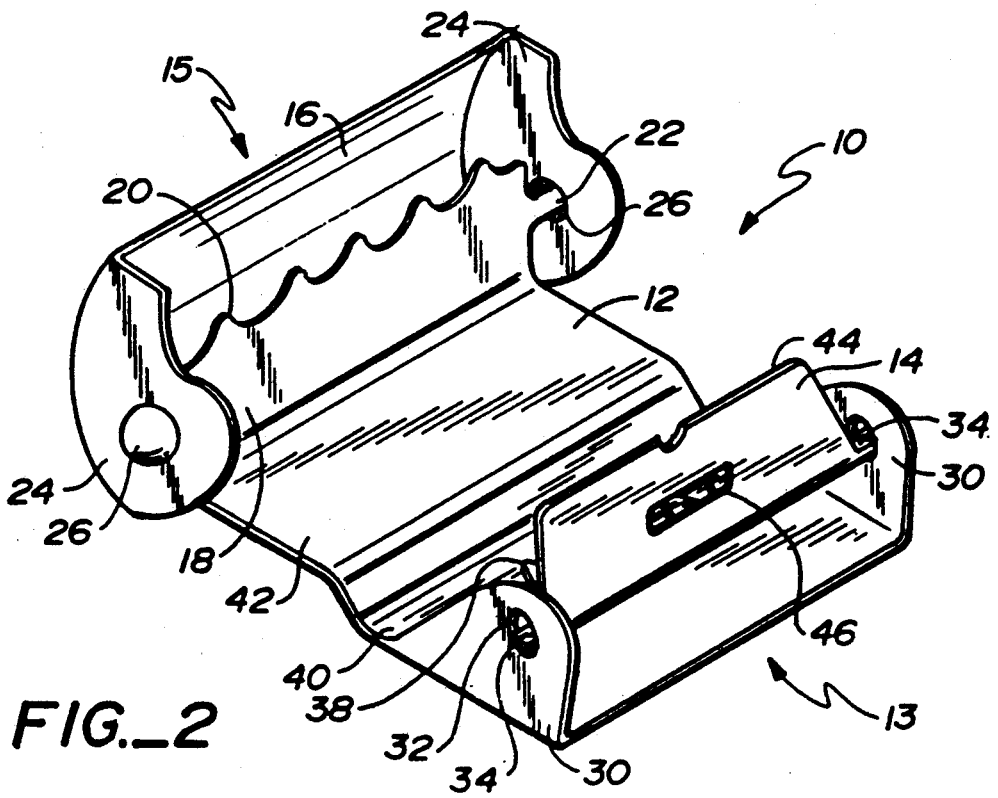
FIG. 2 the buckle of the present invention with the clamp plate and latch plate in the open position, i.e. oriented perpendicular to the frame plate.
Figure 3:
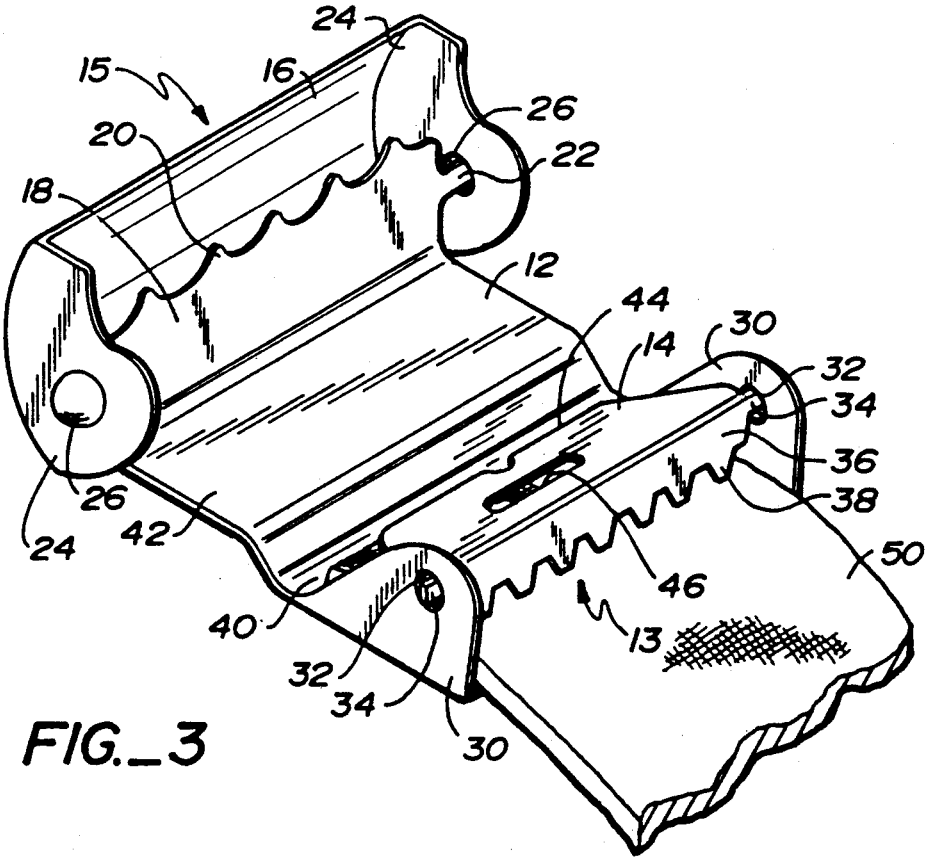
FIG. 3 shows the buckle with the latch plate in the open position and the clamp plate in the closed position securing the suspender strap to the buckle.

The buckle 10 of the present invention is shown in FIGS. 1, 2, and 3. The buckle 10 is composed of a frame plate 12, a clamp plate 14, and a latch plate 16. In this preferred embodiment all the components of the buckle 10 are made of metal. The frame plate 12 has a flange 18 extending at a right angle to the plane of the frame plate 12 at the latch end of the frame 12. The flange 18 has a serrated edge 20. Protruding outwards from the sides of the flange 18 are two fingers 22 (only one of which is visible in FIGS. 1, 2, and 3). The side of the frame plate to which the flange 18 protrudes will hereinafter be referred to as the inside of the frame plate 12, and the other side will be referred to as the outside. The frame plate 12 has a depressed region 40 adjacent the clamp plate 14, and an elevated region 42 adjacent the latch plate 16. At the clamp end of the frame plate 12, two blades 30 project inwards at a right angle to the frame plate 12. Each blade 30 has an aperture 32 (only one aperature 32 is visible in FIG. 2).

The clamp plate 14 has two fingers 34 (only one of which is visible in FIG. 2) which extend through the apertures 32, thereby providing a pivotal attachment of the clamp plate 14 to the frame 12. The clamp plate 14 is bent ninety degrees along a line nearly coincident with the line extending between the two fingers 34 providing a flange 36 extending from the clamp plate 14 near the axis of rotation. The edge of the clamp plate 14 opposite the flange 36 will hereinafter be referred to as the reach edge 44 of the clamp plate 14. The clamp plate 14 has a slot 46 between the reach edge 44 and the flange 36. The slot 46 has a longitudinal axis parallel to the axis of rotation of the clamp plate 14. The pivot provided by the extension of the fingers 34 through the apertures 32 allows the clamp plate 14 to rotate approximately 180 degrees from the orientation shown in FIG. 1 with the clamp plate 14 horizontal and the reach edge 44 pointing away from the frame plate 12, to the orientation of FIG. 2 with the clamp plate 14 vertical, to the orientation of FIG. 3 with the reach edge 44 of the clamp plate 14 pointing inwards.

The flange 36 has a serrated edge 38. When the clamp plate 14 is in the "open" position perpendicular to the frame plate 12, as depicted in FIG. 2, the distance between the serrated edge 38 of the flange 36 and the frame plate 12 is greater than when the clamp plate 14 is in the "closed" position parallel to the frame plate 12, as depicted in FIG. 3. Therefore, when the clamp plate 14 is in the open position a strap 50 can be fed through the gap between the flange 36 and the frame plate 12 and seated in the depression 40 of the frame plate 12. But when the clamp plate 14 is rotated to the closed position shown in FIG. 3 the strap 50 positioned in the depression 40 is wedged between the serrated edge 38 of the flange 36 and the depression 40, thereby preventing the strap 50 from sliding through the buckle 10. A torque exerted on the clamp plate 14 by pulling the engaged strap 50 away from the buckle 10 forces the reach edge 44 of the clamp plate 14 against the frame plate 12 in a region between the depressed region 40 and the elevated region 42.

Figure 4:
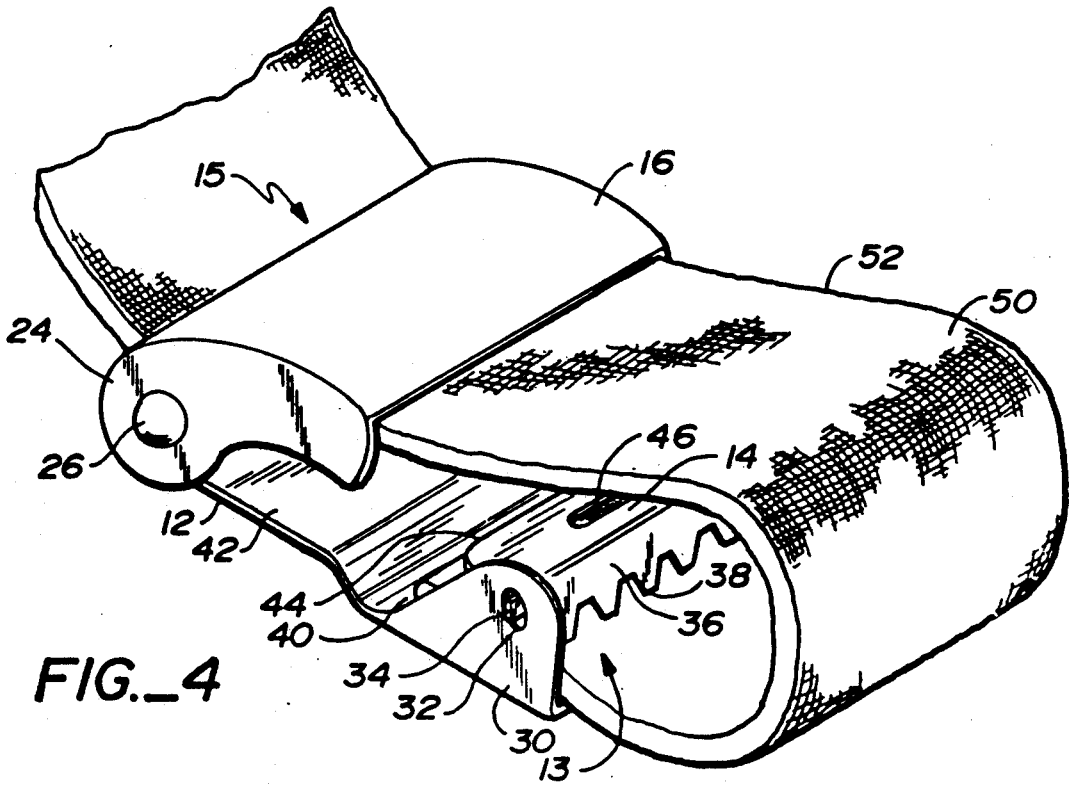
FIG. 4 shows a suspender loop secured by the buckle.

The latch plate 16 has two side walls 24. Dimples 26 in the side walls 24 receive the fingers 22 extending from the flange 18 (only one finger 22 is visible in FIGS. 1, 2 and 3), providing a pivotal attachment of the latch plate 16 to the frame 12. The side of the latch plate 16 to which the wings 24 extend will hereinafter be referred to as the inside of the latch plate 16. The latch plate 16 can be rotated almost 180 degrees from an orientation substantially parallel to the frame plate 12 with the inside of the latch plate 16 facing upwards as depicted in FIG. 1, to an orientation substantially perpendicular to the frame plate 12 as depicted in FIGS. 2 and 3, to an orientation substantially parallel to the frame plate 12 with the inside of the latch plate 16 facing down as shown in FIG. 4. When the latch plate 16 is in the "open" perpendicular orientation shown in FIGS. 2 and 3 the distance between the flange 18 and the latch plate 16 is greater than when the latch plate 16 is in the "closed" orientation shown in FIG. 4. Therefore, when the latch plate 16 is in the open position the strap 50 can be fed through the gap between the flange 18 and the latch plate 16. When the latch plate 16 is then rotated to the closed orientation the strap 50 is forced against the serrated edge 20 of the flange 18, preventing the strap 50 from sliding through the buckle 10. The latch plate 16 extends in both directions past the pivot axis extending between the dimples 26. Therefore when the latch plate 16 is in the closed position, pressure on the outside edge of the plate 16, i.e. the edge of the plate 16 farthest from the center of the frame plate 12, provides a torque which rotates the plate 12 to the open position. Because the edge of the clamp plate 14 opposite the reach edge 44 is almost coincident with the axis of rotation of the clamp plate 14, this plate 14 cannot be moved to the open position by applying a torque to this edge. Rather, the plate 14 must be opened by, for instance, lodging a fingernail between the reach edge 44 and the frame plate 12 and applying an upwards force, or inserting a screwdriver (not shown) in the slot 46 and prying the clamp plate 14 up. The clamp mechanism 13 is therefore not as easy to open as the latch mechanism 15.

To assemble a suspender loop 52 as shown in FIG. 4, the clamp plate 14 is oriented in the vertical open position as depicted in FIG. 2, and an end of the strap 50 is inserted into the depression 40 in the frame plate 12. As the clamp plate 14 is then rotated to the closed position the serrated edge 38 of the clamp flange 36 engages the strap 50 and wedges it between the flange 36 and the depression 40, thereby securing the strap 50 to the buckle 10. With the latch plate 16 in the vertical open position as shown in FIGS. 2 and 3 the other end of the strap 50 is then fed down through the space between the latch plate 16 and the latch flange 18 until the loop 52 of strap 50 is of the desired size. Then the latch plate 16 is rotated to the closed position shown in FIG. 4, wedging the strap 50 between the latch plate 16 and the latch flange 18 and forcing engagement of the teeth of the serrated edge 20 of the flange 18 with the strap 50. This prevents the strap 50 from moving through the buckle 10 and secures the loop 52.

To adjust the size of the loop 52 the latch plate 16 is rotated to the open position by pressing down on the outside edge of the latch plate 16. The strap 50 is then free to slide between the latch plate 16 and the frame plate 12 and the loop 52 can be adjusted to the desired size. Once the loop 52 has been adjusted the latch plate 16 is again closed as described above.

It is sometimes beneficial to disengage the buckle 10 from the suspender strap 50, for instance for cleaning purposes. This is especially necessary with childrens clothing which requires frequent laundering. To remove the strap 50 from the buckle 10 the latch plate 16 is rotated to the open position as described above. The strap 50 can then be withdrawn from between the latch plate 16 and the frame plate 12. Then the clamp plate 14 is rotated to the open position as described above and the strap 50 can be completely disengaged from the buckle 10.

With the foregoing in mind, it will be appreciated that the described improved suspender loop buckle can be quickly and easily assembled with a suspender strap to form a suspender loop using no special tools, and can be easily disengaged from a suspender strap for laundering purposes. While the above description contains many specificities, these should not be construed as limitations on the scope of the invention, but rather as an exemplification of one preferred embodiment thereof. Many other variations are possible within the spirit of the invention, for example: the buckle may be used to form loops or join straps which are to be used for purposes other than suspenders; the flanges need not be serrated; the frame plate, the clamp plate, and the latch plate need not be planar; the pivoting attachments may be constructed in other manners; the clamp flange may be attached to the frame plate rather than the clamp plate; or the latch flange may be attached to the latch plate rather than the frame plate. Accordingly, the scope of the invention should be determined not by the embodiment illustrated, but rather by the appended claims and their legal equivalents.

What is claimed is:

1. A buckle for forming an adjustable loop from a strap of flexible material, comprising:

a) a frame having a back and a front;

b) a latch pivotally attached near a latch end of said frame, said latch being rotatable between an open orientation wherein said strap can be easily inserted between said latch and said frame, and a closed orientation wherein said strap positioned between said latch and said frame is wedged and thereby restrained between said latch and said front of said frame, when said latch is in said closed orientation a force towards said frame exerted on an edge of said latch farthest from the center of said frame will rotate said latch to said open orientation of said latch; and c) a clamp pivotally attached near the end of said frame opposed to said latch end, said clamp being rotatable between an open orientation wherein said strap can be easily inserted between said clamp and said frame, and a closed orientation wherein said strap positioned between said clamp and said frame is wedged and thereby restrained between said clamp and said front of said frame, when said clamp is in said closed orientation a force towards said frame exerted on an edge of said clamp farthest from the center of said frame will not rotate said clamp to said open orientation of said clamp.

2. A buckle for forming an adjustable loop from a strap of flexible material, comprising:

a) a frame plate having a front and back;

b) a latch plate pivotally attached near a latch end of said frame plate and rotatable between a closed orientation wherein said latch plate is substantially parallel to said frame plate and adjacent said front of said frame plate, and an open orientation wherein said latch plate is substantially perpendicular to said frame plate;

c) a latch flange at said latch end of said frame plate, the clearance between and said latch and an edge of said latch flange being greater when said latch plate is in the open orientation than when said latch plate is in the closed orientation;

d) a clamp plate pivotally attached near the end of said frame plate opposed to said latch end; and e) a clamp flange extending from said clamp plate, the clearance between said frame plate and an edge of said clamp flange being greater when said clamp plate is oriented in the open position perpendicular to said frame plate than when said clamp plate is oriented in the closed position parallel to said frame plate and adjacent said front of said frame plate, said clamp flange being located on said clamp plate at a position such that when said clamp plate is in the closed position a force on said clamp flange in a direction away from said frame plate rotates an edge of said clamp plate into contact with said frame plate.

3. The buckle of claim 2 wherein said edge of said clamp flange is serrated.

4. The buckle of claim 3 wherein said edge of said latch flange is serrated.

5. The buckle of claim 4 wherein said frame plate has a depression at the clamp plate end for seating said strap.

6. The buckle of claim 5 wherein said clamp flange extends substantially perpendicularly from said clamp plate.

7. The buckle of claim 6 wherein said latch flange extends substantially perpendicularly from said latch plate.

8. The buckle of claim 7 wherein said latch plate has two side wings and each of said side wings has a dimple, said latch flange has a pair of fingers extending laterally, and wherein said latch plate is pivotally attached to said frame plate by the extension of said latch fingers into said dimples.

9. The buckle of claim 8 wherein said clamp plate has two fingers extending laterally from said clamp plate, and said frame plate has two blades at an end of said frame plate opposed to said latch end, each blade has an aperture, and wherein said clamp plate is pivotally attached to said frame plate by the extension of said clamp fingers through said apertures.

10. The buckle of claim 2 wherein when said latch plate is in said closed orientation a force towards said frame plate exerted on the edge of said latch plate farthest from the center of said frame plate will rotate said latch plate to said open orientation of said latch plate.

11. The buckle of claim 10 wherein when said clamp plate is in said closed orientation a force towards said frame plate exerted on the edge of said clamp plate farthest from the center of said frame plate will not rotate said clamp plate to said open orientation of said clamp plate.

* * * * *

UNITED STATES PATENT AND TRADEMARK OFFICE

CERTIFICATE OF CORRECTION

PATENT NO. : 5,187,839

DATED : February 23, 1993

INVENTOR(S) : Walter Collins

It is certified that error appears in the above-indentified patent and that said Letters Patent is hereby corrected as shown below:

Column 5, line 19, claim 2, delete "and" (first occurrence), and after "latch" insert --plate--.

Signed and Sealed this

Twelfth Day of July, 1994

Bruce Lehman

*Attest:*

BRUCE LEHMAN

*Attesting Officer*

*Commissioner of Patents and Trademarks*